US005760325A

United States Patent [19]

Aoki

[11] Patent Number: 5,760,325

[45] Date of Patent: Jun. 2, 1998

[54] CHORD DETECTION METHOD AND APPARATUS FOR DETECTING A CHORD PROGRESSION OF AN INPUT MELODY

[75] Inventor: Eiichiro Aoki, Hamamatsu, Japan

[73] Assignee: Yamaha Corporation, Japan

[21] Appl. No.: 663,725

[22] Filed: Jun. 14, 1996

[30] Foreign Application Priority Data

Jun. 15, 1995 [JP] Japan ..... 7-171562

[51] Int. Cl.[6] ..... G10H 1/38; G10H 7/00

[52] U.S. Cl. ..... 84/613

[58] Field of Search ..... 84/613, 616, 637, 84/654, 669

[56] References Cited

U.S. PATENT DOCUMENTS 4,951,544 8/1990 Minamitaka ..... 84/613

5,302,776 4/1994 Jeon et al. ..... 84/613

5,510,572 4/1996 Hayashi et al. ..... 84/613 X

*Primary Examiner*—William M. Shoop, Jr.

*Assistant Examiner*—Jeffrey W. Donels

*Attorney, Agent, or Firm*—Rossi & Associates

[57] ABSTRACT

A chord detection method and apparatus for detecting a chord progression for accompaniment of an input melody on a basis of a desired chord applied to a portion of an series of tone pitch sections of the input melody, wherein harmonic tones are extracted from the respective tone pitch sections of the input melody to enumerate each constituent tone of the harmonic tones as a chord candidate for each of the tone pitch sections, and wherein the applied chord and the chord candidate are retrieved in the order of priority with reference to a chord progression suitable for the input melody to determine a chord coincident with the chord progression as each chord of the tone pitch sections.

12 Claims, 6 Drawing Sheets

CHORD DETECTION METHOD AND APPARATUS FOR DETECTING A CHORD PROGRESSION OF AN INPUT MELODY

BACKGROUND OF THE INVENTION

1. Field of the Invention

The present invention relates to a chord detection method and apparatus for automatically detecting a chord progression of an input performance data.

2. Description of the Prior Art

In automatic performance, a chord part, a bass part, a percussion part, etc. are included in accompaniment performed with a melody. For performance of the chord part, bass part and the like, a chord is designated for each unit section of measures to be performed in accordance with progression of the melody. Accordingly, in automatic performance of a melody applied by a user, it is required to designate a chord for each unit section of measures of the melody. To satisfy such requirements, there has been proposed a method of automatically detecting chord tones from the sequential melody data. In such a conventional method, all the chord tones of the melody data are automatically detected by a chord detection apparatus and performed to be confirmed by the user. If the user is not satisfied with performance of the detected chord tones, he can arrange the chord tones to desired chord tones. In the conventional detection method, however, correct detection of all the chord tones may hot be effected due to incomplete technique of the chord detection. If there are plural chord tones to be added in the same performance or melody data, an unwanted or incorrect chord may be detected. Although such a chord can be corrected, the corrected chord may not be harmonized with the other non-corrected sections, resulting in irregularity of the chord progression.

SUMMARY OF THE INVENTION

It is, therefore, a primary object of the present invention to provide a chord detection method and apparatus capable of effecting accurate designation of a desired chord progression for automatic accompaniment in a simple manner.

According to an aspect of the present invention, the object is accomplished by providing a chord detection method for detecting a chord progression for accompaniment of an input melody on a basis of a desired chord applied to a portion of a series of tone pitch sections of the input melody, comprising the steps of detecting a chord candidate for each of the tone pitch sections of the input melody; and retrieving the applied chord and the chord candidate in the order of priority with reference to a chord progression suitable for the input melody to determine a chord coincident with the chord progression as a suitable chord for each of the tone pitch sections.

According to another aspect of the present invention, there is provided a chord detection method for detecting a chord progression for accompaniment of an input melody on a basis of a desired chord applied to a portion of a series of tone pitch sections of the input melody, comprising the steps of detecting a tonality of the input melody; extracting harmonic tones from each of the tone pitch sections of the input melody to enumerate each constituent tone of the harmonic tones as a chord candidate for each of the tone pitch sections of the input melody; and retrieving the applied chord and the chord candidate in the order of priority with reference to a chord progress on of the detected tonality of the input melody to determine a chord coincident with the chord progression as a chord of each of the tone pitch sections.

According to a further aspect of the present invention, there Is provided a chord detection method for detecting a chord progression for accompaniment of an input performance data on a basis of a desired chord applied to a portion of a series of tone pitch sections of the input performance data, comprising the steps of memorizing the input performance data and the desired chord; detecting a tonality of the input performance data; extracting harmonic tones from each of the tone pitch sections in the input performance data to determine each constituent tone of the extracted harmonic tones as a chord candidate for each of the tone pitch sections of the input performance data; determining whether the extracted harmonic, tones coincide with the constituent tones of the memorized chord or not, if not for replacing the memorized chord with a fresh chord; and retrieving the memorized chord or fresh chord and tile chord candidate in the order of priority with reference to a chord progression of the detected tonality of the input melody to detect each chord of the tone pitch sections applicable to the chord progression.

According to an aspect of the present invention, there is provided a chord detection method for detecting a chord progression from an input performance data including a series of tone pitch sections; comprising the steps of memorizing the input performance data and a desired chord applied by a user to a portion of the tone pitch sections of the input performance data; determining a plurality of chord candidates for each of the tone pitch sections in the memorized input performance data; and selecting either one of the chord candidates in the respective tone pitch sections in such a manner that the memorized chord is harmonized with the selected chord candidate.

According to a still another aspect of the present invention, there is provided a chord detection apparatus for detecting a chord progression for accompaniment of an input melody on a basis of a desired chord applied by a user to a portion of a serires of cone pitch sections of the input melody, which comprises means for detecting a tonality of the input melody, means for extracting harmonic tones from each of the tone pitch sections of the input melody t o enumerate each constituent tone of the harmonic tones as a chord candidate for each of the tone pitch sections of the input melody, and means for retrieving the applied chord and the chord candidate in the order of priority with reference to a chord progression of the detected tonality of the input melody to determine a chord coincident with the chord progression as a chord of each or the tone pitch sections.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
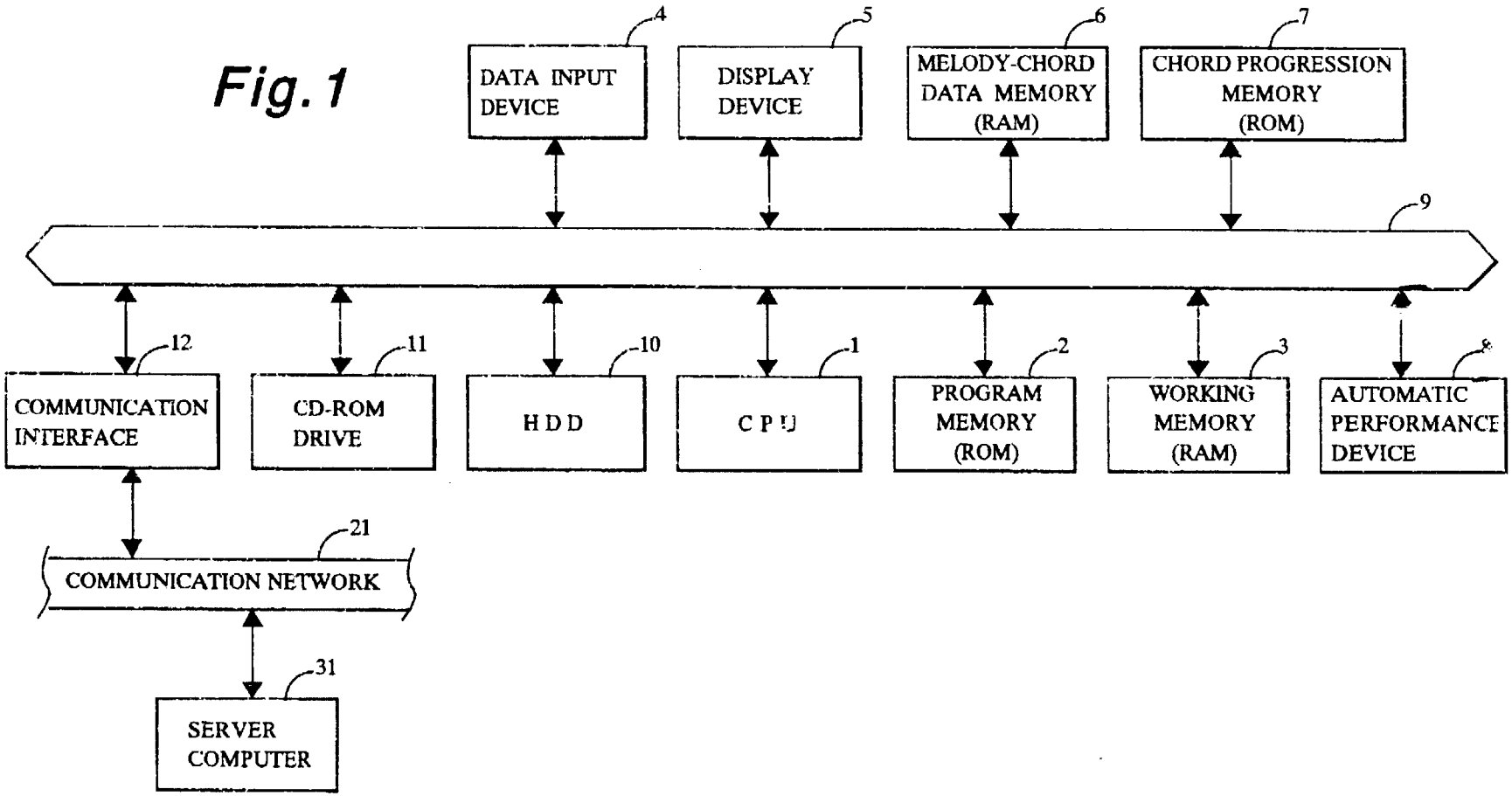
FIG. 1 is a block diagram of a chord detection apparatus in accordance with the present invention.

Illustrated in FIG. 1 of the drawings is a block diagram of a preferred embodiment of a chord detection apparatus for executing a chord detection method in accordance with the present invention. The chord detection apparatus includes a central processing unit or CPU 1 adapted to execute an. operation program stored in a read-only memory or ROM 2 and a working memory 3 in the form of a random access memory or RAM acting as a working. memory during execution of the operation program.

The chord detection apparatus is provided with a data input device 4. a display device 5. a melody-chord data memory 6 and a chord progression memory 7. The data input device 4 is composed of a keyboard and various switches for applying a chord to each section of performance data of a melody. The display device 5 is designed to indicate the applied performance data of the melody in the form of musical notes on a fie-line stave and to indicate an applied chord in each unit section or measure of the performance data. The melody-chord data memory 6 is in the form of a random access memory or RAM to temporarily memorize the melody and chord data applied from the data input device 4. The chord progression memory 7 is in the form of a read-only memory or ROM to store therein various chord data and chord progression data.

The chord detection apparatus is further provided with a hard-disc drive or HDD 10 and a CD-ROM drive 11. The hard-disc drive HDD 10 is adapted to memorize various kinds of data such as the operation program. automatic performance data. the chord progression data and the like. When the operation program is not memorized in the ROM 2. the hard-disc drive HDD 10 acts to memorize the operation program in its hard disc and to apply the memorized operation program to the RAM 3. In such an instance. the CPU 1 reads out the operation program from the RAM 3 and executes the operation program in the same manner as in the case that the operation program is being memorized in the ROM 2. Since the hard-disc drive HDD 10 has a read/write function. addition or version-up of the operation program can be made in a simple manner. The CD-ROM drive 11 is adapted to read out the operation program and various data memorized in a CD-ROM and apply them to the hard disc in the hard-disc drive HDD 10. With the CD-ROM drive 11 new installation or version-up of the operation program can be made in a simple manner. In addition. an external memory media such as a floppy disc drive or FDD or an optical magnetic disc may be adapted to the chord detection apparatus.

The chord detection apparatus is provided with a communication interface 12 connected to a server computer 3l by way of local area network or a telecommunication network such as an internet. a telegraph circuit or the like. When the operation program and various data are not memorized in the hard-disc drive or HDD 10. the communication interface 12 acts to effect down-load of the operation program and various data to the hard-disc drive or HDD 12 from the server computer 31. In an actual practice. the chord detection apparatus acts as a client to transmit a command signal for down-load of the operation program and various data to the server computer 31 through the communication interface 12 and telecommunication network 21. When applied with the command signal. the server computer 31 applies the operation program and various data to the chord detection apparatus through the communication network 21. When applied with the operation program and various data through the communication interface 12. the chord detection apparatus acts to accumulate the operation program and various data in the hard-disc drive or HDD 10 thereby to complete down-load of the applied data.

Hereinafter. operation of the chord detection apparatus will be described in detail with reference to a screen of the display device 5. Illustrated in FIG. 2(A) is a display screen of a melody data applied from the data input device 4. In this display screen. musical notes of the melody are indicated on a five-line stave. and desired chords "$G_7$" and "C" inputted by the user are indicated above fourth and seventh measures of the melody respectively. The character "?" is indicated above the other measures where there is not any chord inputted by the user. In automatic detection of a chord progression. a key or tonality of the input melody is detected. In this instance. the notality of the input melody is detected as a C major. Subsequently. harmonic tones are extracted from each measure in a unit section. and each constituent tone of the harmonic tones is enumerated as a chord candidate for the respective measures as shown in FIG. 2(B). For instance. chords "Dm. $Dm_7$. . . . " are represented as chord candidates for the first measure. chords "$G_7$. . . . " are represented as chord candidates for the second measured chords "C. $C_7$. . . . " are represented as chord candidates for the fifth measure. chords "F. $F_7$. . . . " are represented as chord candidates for the fifth measure. chords "Fm. A. . . . " are represented as chord candidates for the Sixth measure . In addition. each note of the harmonic tones is indicated with the character "*".

Figure 2:
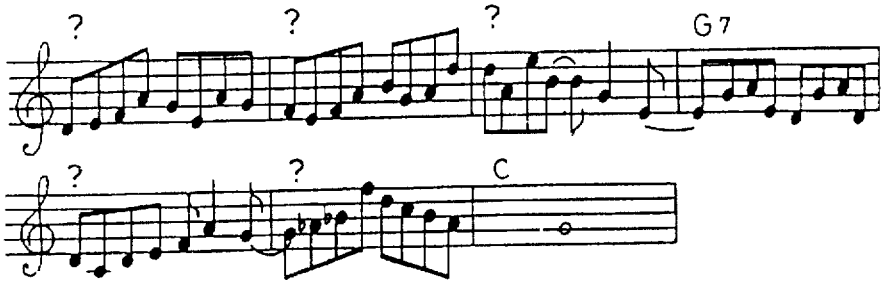
FIGS. 2(A)–2(C) illustrate each screen indicated on a display device of the chord detection apparatus.
Figure 2B:
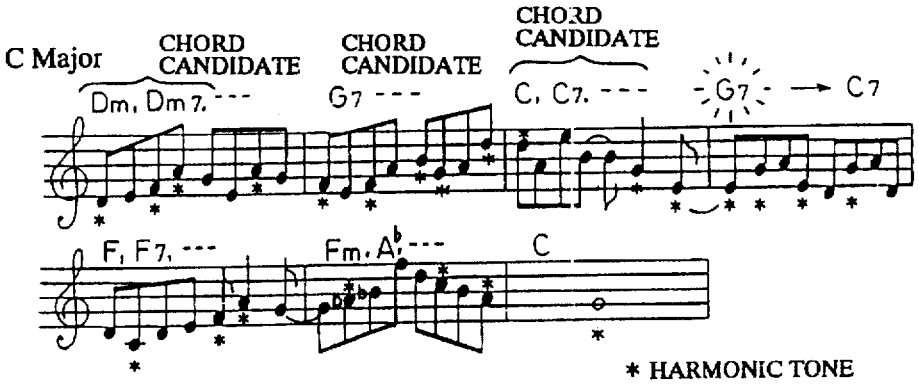
Figure 3:
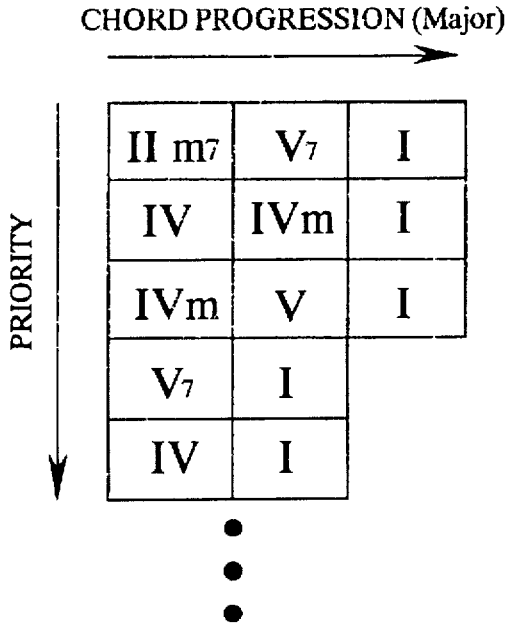
FIG. 3 is a chord progression table adapted for use in the chord detection apparatus.

If in extraction of the harmonic tones. the constituent tones of the input chords do not coincide with all the harmonic tones extracted from the respective measures. the input chords are blinked as shown in FIG. 2(B). In this instance. the input chord "$G_7$" for the fourth measure Is blinked to be corrected to a fresh chord "$C_7$". Subsequently. the chord candidates for the respective measures are retrieved in the order of priority with reference to a chord progression table of the tonality of the melody to determine a chord candidate coincident with the chord progression as a suitable chord for the measure. Illustrated in FIG. 3 is a chord progression table of the C major to be retrieved. In the cord progression table. the order of priority in the chord progression is represented by an ordinate. and the order of chords in progression is represented by an abscissa. For instance. in the chord progression of C major. a chord progression of a highest priority. order is determined as $IIm_7$–$v_7$–I. In the chord progression. the characters II. V. I each represent a tonic. the character $IIm_7$ represents a 2nd minor 7th chord. the character $V_7$ represents a dominant 7th chord. and the character I represents a 1st chord or tonic chord.

Figure 4:
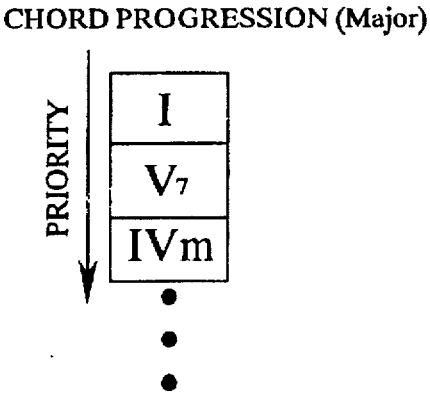
FIG. 4 is a chord table adapted for use In the chord detection apparatus.

Assuming that a chord progression of the first to third measures in the input melody is retrieved with reference to the chord progression table in FIG. 3. chords $Dm_7$. $G_7$ and C correspond with the chords $IIm_7$. v7 and I in the highest priority order. respectively. Thus. the chords $Dm_7$. $G_7$ and C are determined as the respective chords of the first. second and third measures. When a chord progression of the fifth to seventh measures is retrieved with reference to the chord progression table in FIG. 3. the chords F. Fm and C correspond with the chords IV. IVm and I in the second line (IV–IVm–I) of the chord progression table. respec- tively. Thus. the chords of the fifth to seventh measures are determined as the chords F, Fm and C, respectively. Since the chord of the fourth measure is being determined by the user, the chords of all the measures are determined and indicated on the screen of the display device 5 as shown in FIG. 2(c). In case there is not any chord candidate in the chord progression table shown in FIG. 3, a chord candidate is determined with reference to a chord table of FIG. 4 wherein three chords of the C major are vertically aligned in the order of priority.

Figure 5:
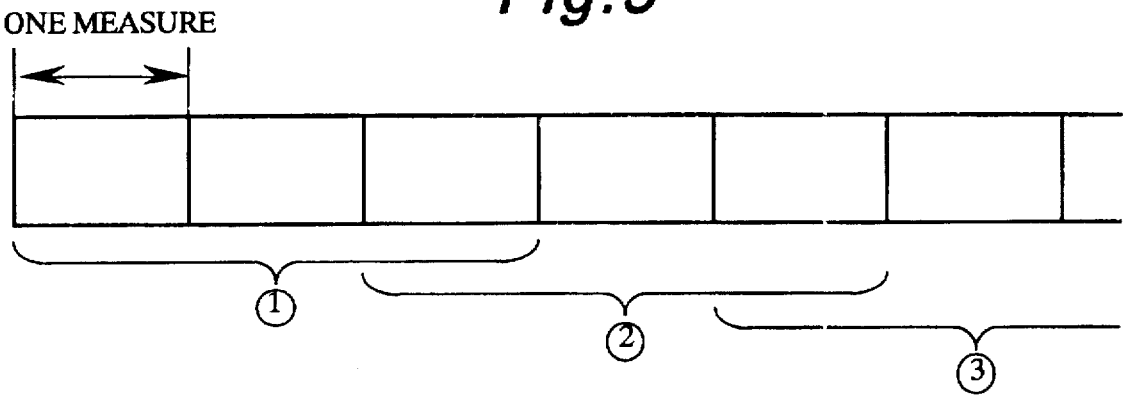
FIG. 5 illustrates a method of dividing measures of an applied melody into desired sections.

Illustrated in. FIG. 5 is an example of a method for dividing the measures of the input melody for detection of each chord of the measures during retrieval of the chord progression table shown in FIG. 3. For detection of the chord progression, first to third measures are divided cut of the melody as a first section as shown by the reference numeral (1) in FIG. 5 and retrieved with reference to the chord progression table of FIG. 3 to detect each chord of the first to third measures from the chord candidates in the chord progression table. Subsequently, the third to fifth measures divided out of the melody, as a second section as shown by the reference numeral (2) is retrieved with reference to the chord progression table of FIG. 3 to detect each chord of the fourth and fifth measures, and the fifth to seventh measures divided out of the melody as a third section as shown by the reference numeral (3) is retrieved with reference to the chord progression table to detect each chord of the sixth and seventh measures. Thereafter, each chord of the following measures is detected in the same manner as described above.

If there is not any chord progression applicable to each section of three measures In retrieval of the chord progression table, a section two measures is successively divided out of the melody, to detect each chord of the measures. In this instance each section of two measures is divided out of the melody in such a manner as to include the second measure of the previous section of two measures. If there Is not any chord progression applicable to the section of two measures in retrieval of the chord progression, the section of two measures is reserved, and the following Section of two measures is retrieved with reference to tile chord progression table. When the final section off two measures is retrieved to detect the chord progression, the reserved section of two measures is retrieved with reference to the chord table shown in FIG. 4 to determine chord of the reserved section.

Figure 2C:
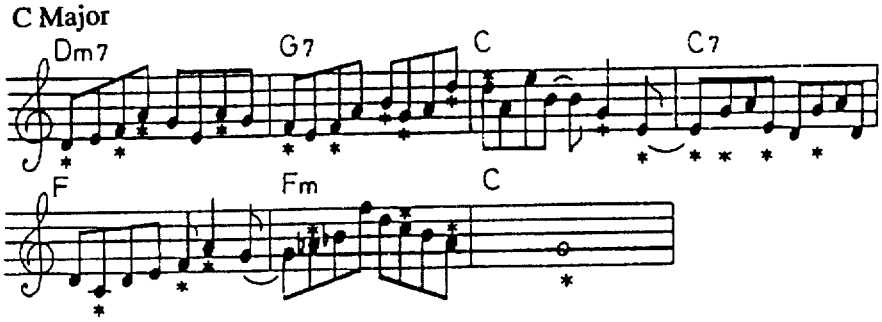

In chord detection of the melody shown in FIG. 2, the first to third measures are divided out of the melody as a first section, and a chord progression applicable to the first section of the first to third measures is retrieved with reference to the chord progression table of FIG. 3 to determine each chord of the measures. Subsequently, the third to fifth measures are divided out of the melody as a second section, and a chord progression applicable to the second section of the third to fifth measures Is retrieved with reference to the chord progression. Since in this instance, the chord of the fourth measure is being determined as "$C_7$" by the user, the chord progression of the three measures is retrieved in the form of a chord progression "C–$C_7$–?". As the chord progression "C–C7–?" is not included in the chord progression table of. FIG. 3, a section of the third and fourth measures is divided out of the melody, and a chord progression applicable to the section of the third and fourth measures is retrieved with reference to the chord progression table In this instance, a chord progression of the following measure is detected since the chord progression "C–C7" is already determined.

Subsequently, the fourth to sixth measures are divided out of the melody as a third section and a chord progression applicable to the third section is retrieved as "$C_7$–?–?". As the chord progression "$C_7$–?–?" is not included in the chord progression table, a section the fourth and fifth measures is divided out of the melody to retrieve the chord progression. "$C_7$–?" with reference to the chord progression table. In this instance, the fifth measure is reserved because of no presence of the chord progression "C7–?" in the chord progression table, and in turn, a fourth section of the fifth to seventh measures is divided out of the melody to retrieve a chord progression applicable to the fourth section with reference to the chord progression table of FIG. 3. As the chord of the seventh measure is being determined as "C" by the user, a chord progression "F–?–C" is retrieved with reference to the chord progression table. In this instance, the chord progression on the second line of the table corresponds with a chord progression applicable to the fourth section. As a result, the chord progression of the fourth section including the reserved measure is determined as "F–Fm–C"

Figure 6:
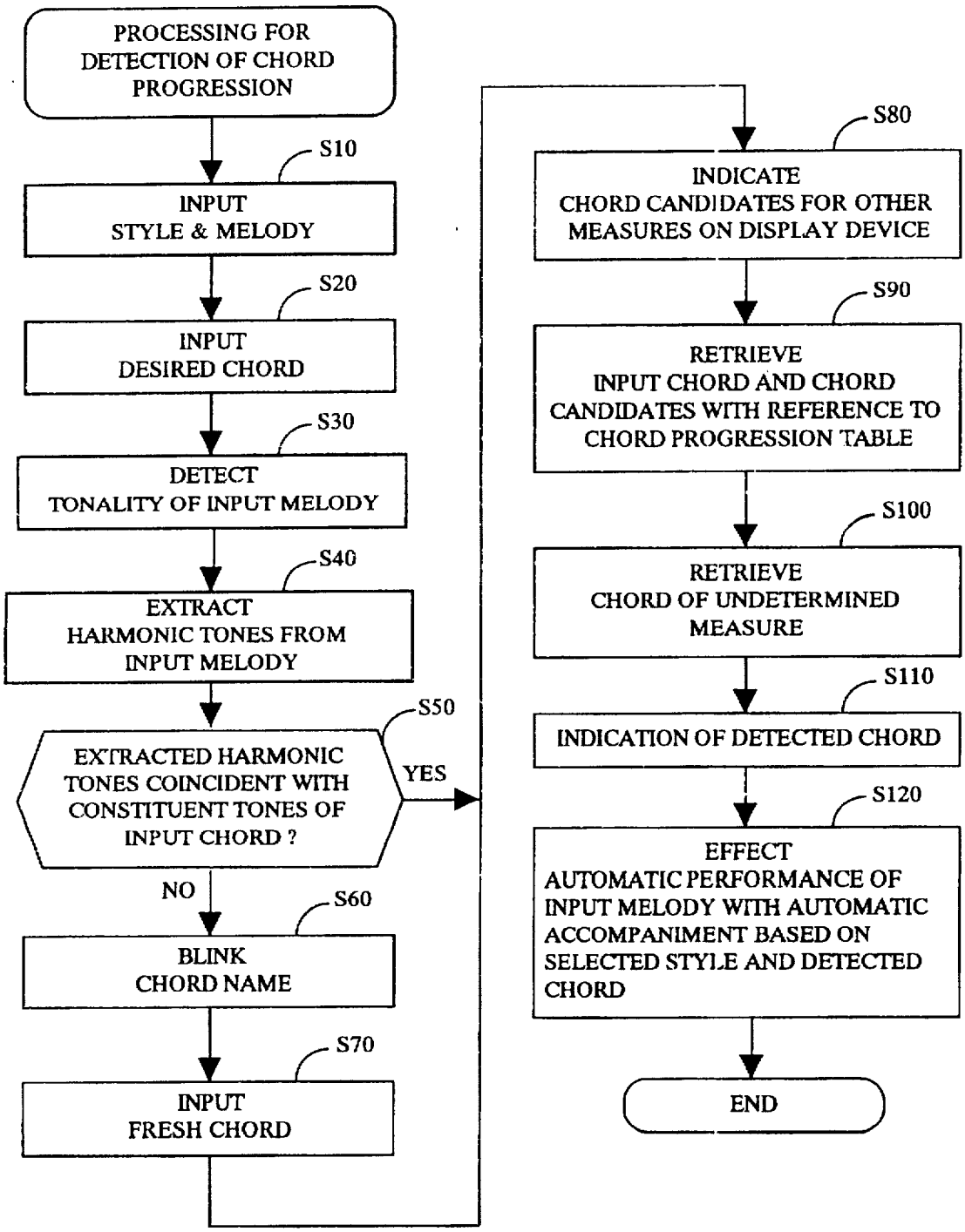
FIG. 6 is a flow chart of processing for detection of a chord progression in the chord detection apparatus.

The foregoing detection of the chord progression is effected by execution of an operation program shown by a flow chart in FIG. 6. Assuming that detection of the chord progression has been instructed by the user, the data input device 4 is operated by the user at step S1O to store a melody data and a style data indicative of a performance style such as jazz, rock, dance, waltz, etc. In the melody-chord data memory 6 and to indicate the melody data on the screen of the display device 5 in the form of musical notes on a five-line stave. At step S20 of the operation program, the data input device 4 is operated by the user to memorize desired chords of a portion of measures in the melody-chord data memory 6 and to indicate the desired chords of the measures on the screen of the display device 5 as shown in FIG. 2(A). In turn, the CPU 1 detects at step S30 a tonality of the input melody in the memorized melody data and extracts at step S40 harmonic tones from the memorized melody to indicate the harmonic tones with an asterisk(*) on the screen of the display device 5 as shown in FIG. 2(B).

Subsequently, the CPU 1 determines at step S50 whether the extracted harmonic tones coincide with the constituent tones of the applied chord or not. If the harmonic tones do not coincident with the constituent tones of the applied chord In the fourth measure as shown in FIG. 2(B), the CPU 1 determines a "No" answer at step S5O and causes the indicated chord name "$G_7$ " at step S60 to blink. When the data input device 4 is operated by the user to replace the chord "$G_7$" with a fresh chord. "$C_7$", the melody-chord data memory 6 memorizes the fresh chord "$C_7$", and the display device 5 indicates the fresh chord "$C_7$" thereon at step S70. When all the harmonic tones of the melody coincide with the constituent tones of the applied chords in the fourth and seventh measures as shown in FIG. 2(B), the CPU 1 determines a "Yes" answer at step S50 and causes the program to proceed to step S80. Thus, the CPU 1 causes the display device 5 to indicate chords including all the extracted harmonic tones as chord candidates for the other measures as shown in. FIG. 2(B).

In such a situation as described above, the CPU 1 retrieves at step S90 the applied chords and the chord candidates in the order of priority with reference to the memorized chord progression table to determine each chord of the measures applicable to the chord progression table. In this instance, the measures of the melody are divided as shown in FIG. 5. If there is a measure the chord of which may not be determined during retrieval of the chord progression, the CPU 1 retrieves the measure with reference to the chord table of FIG. 4 at step S10 to determine a chord in the highest order of priority in the detected tonality as a chord of the measure. After determination of each chord of the measures, the CPU 1 causes the display device 5 at step S110 to indicate each chord of the measures as shown in FIG. 2(C). Thus, when the automatic performance switch is operated, the CPU 1 causes the automatic performance device 8 at step S120 to effect automatic performance of the melody with automatic accompaniment based on the selected style and the detected chords.

Figure 7A:
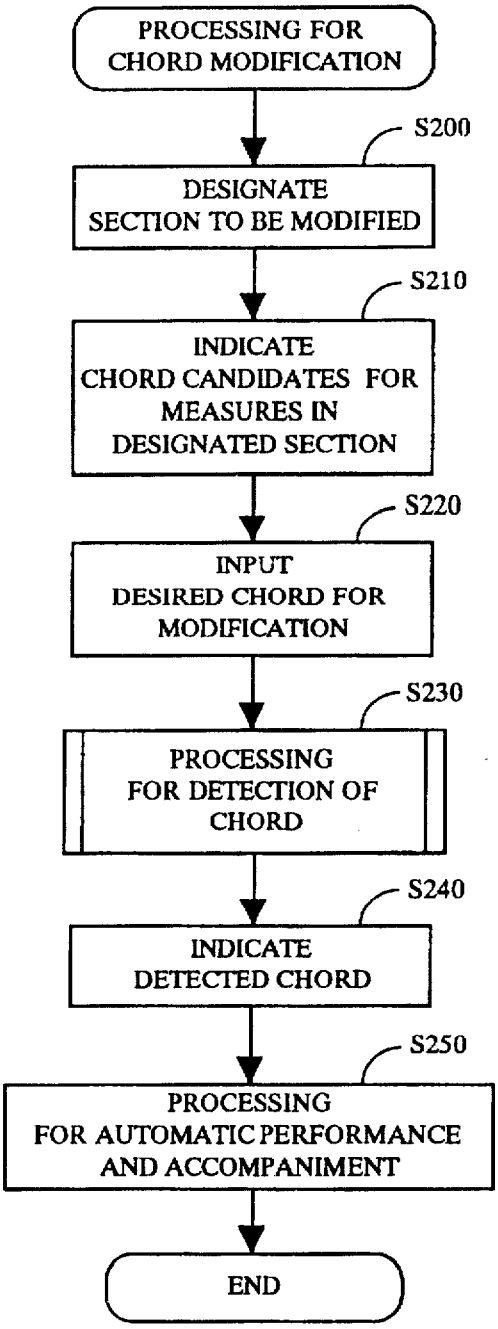
FIG. 7(A) is a flow chart of processing for chord modification and FIG. 7(B) is a flow chart for processing for detection of chords.
Figure 7B:
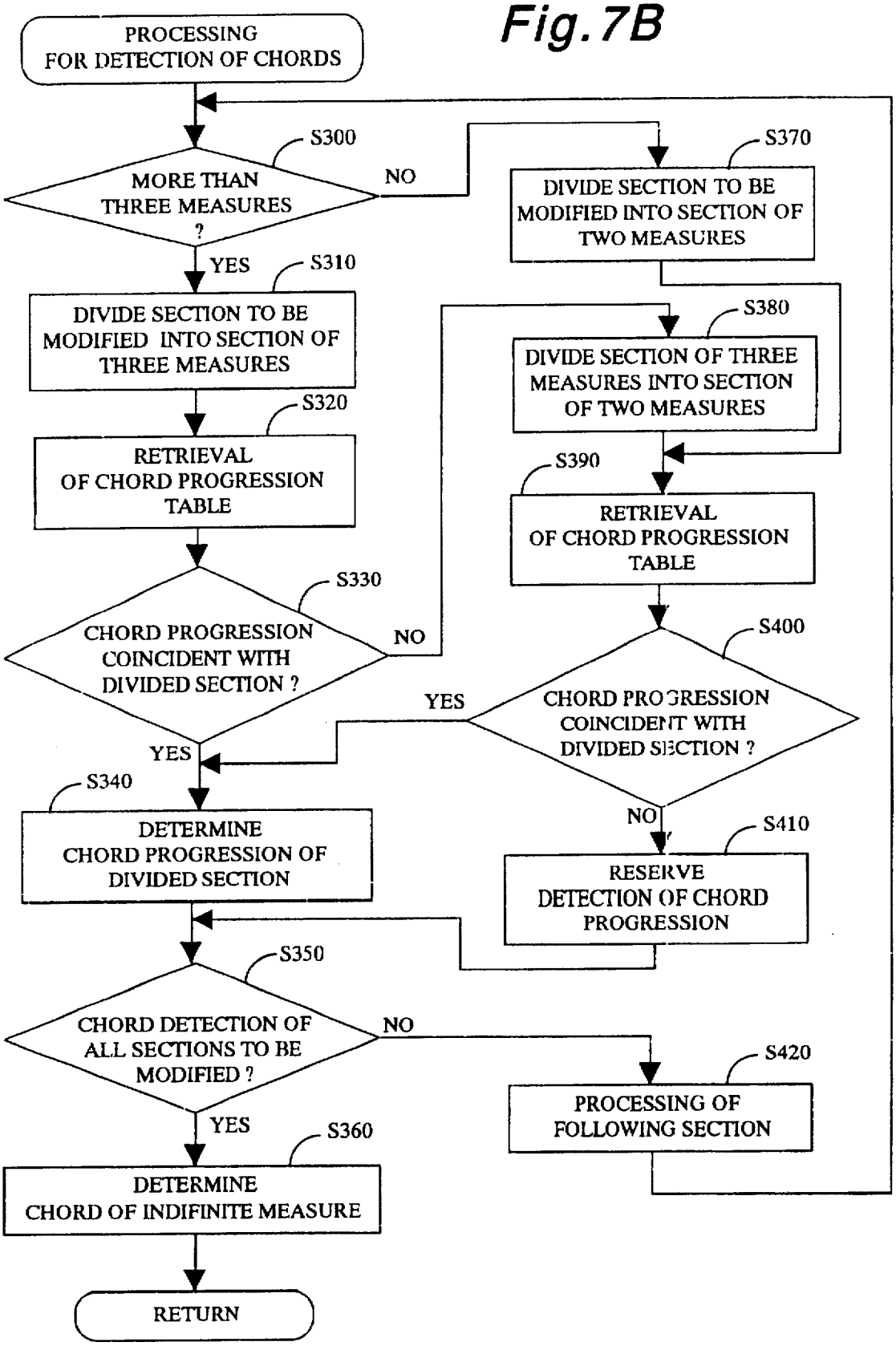

In the chord detection apparatus according to the present invention, the chord progression of the melody can be partly modified by the user as described in detail below. Illustrated in FIGS. 7(A) and 7(B) is a flow chart of an operation program for modification of the chord progression. Assuming that processing of the operation program shown in FIG. 7(A) has been started by operation of the user, a section of the chord progression to be modified is designated by the user at step S200. Although the designation of the section is made to modify an unwanted section in the automatic determination of the chord progression, the entirety of the melody may be designated. In this instance, the CPU 1 causes the display device 5 at step S210 to indicate chord candidates of measures in the designated section as shown in FIG. 2(B). Thus, at step S220, a desired chord is designated by the user from the chord candidates indicated on the screen of the display device 5. If there is not any desired chord in the chord candidates, a fresh chord may be inputted by the user. Thereafter, the CPU 1 executes processing for detection of the chords at step S230 to determine a chord progression of the designated section as described below.

When processing for detection of the chords has beer started, the CPU 1 determines at step S300 whether the section to be modified is more than three measures or not. If the answer at step S300 is "Yes", the program proceeds to step S310 where the section to be modified is divided into a section of, three measures for detection of a chord. Subsequently, the CPU 1 retrieves at step S320 the chord progression table of FIG. 3 and determines at step S330 whether there is a chord progression coincident with the Section or not. If the answer at step S330 is "Yes", the program proceeds to step S340 where the CPU 1 determines a chord progression of the divided section. If the answer at step S330 is "No", the program proceeds to step S380, where the CPU 1 divides the section of three measures Into a second of two measures. At the following step S390, the CPU 1 retrieves the chord progression table of FIG. 3 and causes the program to proceed to step S400 for determining a result of retrieval of the chord progression. If there is a card progression coincident with the section of two measures,s the CPU 1 determines a "Yes" answer at step S440 and determines a chord progression of the section of two measures at step S340. If there is not any chord progression coincident with the section of two measures, the CPU 1 determines a "No" answer and reserves detection of a chord progression of the section at step S410.

When section to be modified is less three measures, the CPU 1 determines a "No" at step S330 and divides the section to be modified into a section of two measures at step S370. A chord progression of the section of two measures is detected by processing at step 390 in the same manner as described above. After processing at step S340 or S410, the program proceeds to step S350 where the CPU 1 determines whether chord detection of all the sections to be modified has finished or not. If the answer at step S350 is "No", the CPU I returns the program to step S300 for processing of the following section. In turn, the CPU 1 executes processing for chord detection of the following section at step S300–340 or S370–S410. Such processing for chord detection is successively executed until it is determined by the CPU 1 at step S350 that chord detection of all the sections to be modified has finished.

When chord detection of all the sections to be modified has finished, the CPU 1 determines a "Yes" answer at step S350 and causes the program to proceed to step S360. If there is a measure he chord progression of which is still Indefinite, the CPU 1 determines at step S360 a chord of the indefinite measure with reference to the chord table of FIG. 4 and returns the program to the processing for modification of the chords.

Although in the above embodiment one measure has been defined as a unit of the chord section, a half measure or other measure may be defined as a unit of the chord section. The chord section may be also determined in a different length in accordance with the style of the melody or the length of the chord section may be determined by the user.

Although a chord unsuitable for the chord progression has been indicated by a blink signal, a voice alarm or letter indication may be adapted to inform the user of the unsuitable chord. Although the chord detection method of the present invention has been realized by a central processing unit or CPU programmed to execute the chord detection program, the chord detection method may be realized by a hardware.

Although the chord progression table has been designed to memorize a chord progression of three measures and to memorize a chord progression of two measures, a chord progression of more than four measures or another chord progression may be memorized in the chord progression table. Although in the chord detection described above, designated by the user, a desired chord may be selectively designated from chord candidates previously detected. In case there is not any desired chord in the chord candidates, a fresh chord may be designated.

After processing for detection of the chords at step 230, the CPU 1 causes the display device 5 at step S240 to indicate each chord of the measures thereon as shown in FIG. 2(C). Thus, when the automatic performance switch is operated by the user, the CPU 1 causes the automatic performance device 8 at step S250 to effect automatic performance of the melody with automatic accompaniment based on the selected style and detected chords.

What is claimed is:

1. A chord detection method for detecting a chord progression for accompaniment of an input melody on a basis of a desired chord applied to a portion of a series of tone pitch sections of the input melody comprising the steps of:

detecting a chord candidate for each of the tone pitch sections of the input melody; and retrieving the applied chord and the chord candidate in the order of priority with reference to a chord progression suitable for the input melody to determine a chord coincident with the chord progression as a chord for each of the tone pitch sections.

2. A chord detection method for detecting a chord progression for accompaniment of an input melody on a basis of a desired chord applied to a portion of a series of tone pitch sections of the input melody, comprising the steps of:

detecting a tonality of the input melody;

extracting harmonic tones from each of the tone pitch sections of the input melody to enumerate each constituent tone of the harmonic tones as a chord candidate for each of the tone pitch sections of the input melody; and retrieving the applied chord and the chord candidate in the order of priority with reference to a chord progression of the detected tonality of the input melody to determine a chord coincident with the chord progression as a chord of each of the tone pitch sections.

3. A chord detection method for detecting a chord progression for accompaniment of an input performance data on a basis of a desired chord applied to a portion of a series of tone pitch sections of the input performance data, comprising the steps of:

memorizing the input performance data and the desired chord;

detecting a tonality of the input performance data;

extracting harmonic tones from each of the tone pitch sections in the input performance data to determine each constituent tone of the extracted harmonic tones as a chord candidate for each of the tone pitch sections of the input performance data;

determining whether or not the extracted harmonic tones coincide with the constituent tones of the memorized chord or not, and if not for replacing the memorized chord with a fresh chord; and retrieving the memorized chord or fresh chord and the chord candidate in the order of priority with reference to a chord progression of the detected tonality of the input melody to detect each chord of the tone pitch sections applicable to the chord progression.

4. A chord detection method for detecting a chord progression from an input performance data including a series of tone pitch sections; comprising the steps of:

memorizing the input performance data and a desired chord applied by a user to a portion of the tone pitch sections of the input performance data;

determining a plurality of chord candidates for each of the tone pitch sections in the memorized input performance data; and selecting either one of the chord candidates in the respective tone pitch sections in such a manner that the memorized chord is harmonized with the selected chord candidate.

5. A chord detection method as recited in claim 4, wherein the step of determining a plurality of chord candidates for each of the tone pitch sections comprises the steps of extracting harmonic tones from the memorized input performance data and of determining constituent tones of the harmonic tones as chord candidates for each of the tone pitch sections.

6. A chord detection method as recited in claim 4, wherein the step of selecting either one of the chord candidates in the respective tone pitch sections comprises the steps of retrieving the memorized chord and the chord candidates in the respective tone pitch sections with reference to a memorized chord progression suitable for the input performance data and of determining a chord candidate coincident with the chord progression as each chord of the tone pitch sections.

7. A chord detection apparatus for detecting a chord progression for accompaniment of an input melody on a basis of a desired chord applied to a portion of a series of tone pitch sections of the input melody, comprising:

means for detecting a chord candidate for each of the tone pitch sections of the input melody; and means for retrieving the applied chord and the chord candidate in the order of priority with reference to a chord progression suitable for the input melody to determine a chord coincident with the chord progression as a suitable chord for each of the tone pitch sections.

8. A chord detection apparatus for detecting a chord progression for accompaniment of an input melody on a basis of a desired chord applied to a portion of a series of tone pitch sections of the input melody, comprising:

means for detecting a tonality of the input melody;

means for extracting harmonic tones from each of the tone pitch sections of the input melody to enumerate each constituent tone of the harmonic tones as a chord candidate for each of the tone pitch sections of the input melody; and means for retrieving the applied chord and the chord candidate in the order of priority with reference to a chord progression of the detected tonality of the input melody to determine a chord coincident with the chord progression as a suitable chord of each of the tone pitch sections.

9. A chord detection apparatus for detecting a chord progression for accompaniment of an input performance data on a basis of a desired chord applied to a portion of a series of tone pitch sections of the input performance data, comprising:

means for memorizing the input performance data and the desired chord;

means for detecting a tonality of the input performance data;

means for extracting harmonic tones from each of the tone pitch sections in the input performance data to determine each constituent tone of the extracted harmonic tones as a chord candidate for each of the tone pitch sections of the input performance data;

means for determining whether or not the extracted harmonic tones coincide with the constituent tones of the memorized chord or not, and if not for replacing the memorized chord with a fresh chord; and means for retrieving the memorized chord or fresh chord and the chord candidate in the order of priority with reference to a chord progression of the detected tonality of the input melody to detect each chord of the tone pitch sections applicable to the chord progression.

10. A chord detection apparatus for detecting a chord progression from an input performance data including a series of tone pitch sections; comprising:

means for memorizing the input performance data and a desired chord applied by a user to a portion of the tone pitch sections of the input performance data;

means for determining a plurality of chord candidates for each of the tone pitch sections in the memorized input performance data; and means for selecting either one of the chord candidates in the respective tore pitch sections in such a manner that the memorized chord is harmonized with the selected chord candidate.

11. A memory media adapted for use in a chord detection apparatus for detecting a chord progression for accompaniment of an input melody on a basis of a desired chord applied to a portion of a series of tone pitch sections of the input melody, said memory media comprising:

means for detecting a chord candidate for each of the tone pitch sections or the input melody; and means for retrieving the applied chord and the chord candidate in the order of priority with reference to a chord progression suitable for the input melody to determine a chord coincident with the chord progression as a chord for each of the tone pitch sections.

12. A memory media adapted for use in a chord detection apparatus for detecting a chord progression for accompaniment of an input melody on a basis of a desired chord applied to a portion of a series of tone pitch sections of the input melody, said memory media comprising:

means for detecting a tonality of the input melody;

means for extracting harmonic tones from each of the tone pitch sections of the input melody to enumerate each constituent tone of the harmonic tones as a chord candidate for each of the tone pitch sections of the input melody; and means for retrieving the applied chord and the chord candidate in the order of priority with reference to a chord progression of the detected tonality of the input melody to determine a chord coincident with the chord progression as a chord of each of the tone pitch sections.

* * * * *